US009909846B2

(12) United States Patent
Ervin

(10) Patent No.: US 9,909,846 B2
(45) Date of Patent: Mar. 6, 2018

(54) FIREARM TARGET WITH LOCK ON PATTERN

(71) Applicant: Thomas D. Ervin, Taos, NM (US)

(72) Inventor: Thomas D. Ervin, Taos, NM (US)

( * ) Notice: Subject to any disclaimer, the term of this patent is extended or adjusted under 35 U.S.C. 154(b) by 0 days.

(21) Appl. No.: 15/621,763

(22) Filed: Jun. 13, 2017

(65) Prior Publication Data

US 2018/0010892 A1 Jan. 11, 2018

Related U.S. Application Data

(63) Continuation-in-part of application No. 15/222,022, filed on Jul. 28, 2016, now Pat. No. 9,709,364.

(60) Provisional application No. 62/360,024, filed on Jul. 8, 2016.

(51) Int. Cl.
*F41J 1/00* (2006.01)
*F41J 5/00* (2006.01)

(52) U.S. Cl.
CPC .. *F41J 1/00* (2013.01); *F41J 5/00* (2013.01)

(58) Field of Classification Search
CPC ..... F41J 1/10; F41J 1/00; F41J 3/00; F41J 3/0004; F41J 3/0009; F41G 3/26; F41G 1/54; F41G 3/323
USPC ..... 273/403–409, 348; 434/19; D22/113
See application file for complete search history.

(56) References Cited

U.S. PATENT DOCUMENTS

D33,151 S * 9/1900 Boggis ..... 273/236
1,203,472 A * 10/1916 Branch ..... A63F 9/0208 273/146
1,295,993 A * 3/1919 Kleissl ..... A63F 3/00075 273/241
D211,467 S * 6/1968 Wilbur ..... D21/307
D255,700 S * 7/1980 Dulude ..... D21/306
D255,822 S * 7/1980 Dulude ..... D21/306
D256,041 S * 7/1980 Dulude ..... D21/306
4,244,586 A * 1/1981 Gorrow ..... F41G 1/54 273/408
D259,357 S * 5/1981 Dulude ..... D22/113
D262,819 S * 1/1982 Dulude ..... 273/409
D269,631 S * 7/1983 Dulude ..... 273/409
D271,890 S * 12/1983 Astwood, Sr. ..... 273/409
5,066,020 A * 11/1991 Trudeau ..... A63F 9/0208 273/408
5,415,415 A * 5/1995 Mujic ..... F41J 1/01 273/408
6,213,470 B1 * 4/2001 Miller ..... F41G 1/54 273/409
D455,811 S * 4/2002 Fedio, Jr. ..... D22/113
9,709,364 B1 * 7/2017 Ervin ..... F41J 1/00
(Continued)

*Primary Examiner* — Mark Graham
(74) *Attorney, Agent, or Firm* — Richard Krukar

(57) ABSTRACT

A firearm target is specially adapted for the purpose of sighting in a scoped firearm. The scope has a reticle with horizontal and vertical lines forming crosshairs. The target has a cross pattern in contrasting colors with a cross shaped gap. The gap is highly visible and may even be in a reflective color. The gap size is selected to match the crosshair thickness and the targeting distance. Aligning the crosshairs to the gap significantly or completely hides the gap. Misaligning the crosshairs to the gap causes the gap to become more visible because of the gap's highly noticeable and contrasting colors. The target thereby provides a lock-on functionality for a marksman.

20 Claims, 9 Drawing Sheets

(56) References Cited

U.S. PATENT DOCUMENTS

| | | | | |
|---|---|---|---|---|
| D798,986 | S * | 10/2017 | Ervin | D22/113 |
| 2004/0090010 | A1 * | 5/2004 | Wilson | A63F 3/04 273/317 |

* cited by examiner

400

500

600

FIREARM TARGET WITH LOCK ON PATTERN

CROSS REFERENCE TO RELATED APPLICATIONS

This patent application is a continuation-in-part of U.S. patent application Ser. No. 15/222,022 titled "Firearm Target with Lock On Pattern", filed on Jul. 28, 2016 and claims the priority and benefit of U.S. provisional patent application 62/360,024, titled "Firearm Target with Lock On Pattern", filed on Jul. 8, 2016, application Ser. No. 15/222,022 and 62/360,024 are incorporated herein by reference in their entirety.

FIELD OF THE EMBODIMENTS

Embodiments are generally related to firearm targets and methods for manufacturing firearm targets.

BACKGROUND

Targets for projectiles have existed since prehistoric times with occasional advances in the art providing targets that are more appropriate for specific uses. Among those advances are printed targets where a target pattern, such as the notoriously familiar bullseye pattern, is printed onto a substrate such as paper, card stock, or plastic. More recently, firearm targets have been developed with frangible or separable ink over a brightly colored substrate for causing the point of impact to be highly visible. The point of impact is highly visible because a separable ink or layer breaks away from the substrate in a ring or halo around the point of impact, thereby revealing a halo of brightly colored substrate material.

U.S. Pat. No. 5,188,371 titled "Reusable Projectile Impact Reflecting Target for Day or Night Use" issued to Edwards on Feb. 23, 1993 and is herein incorporated by reference in its entirety. U.S. Pat. No. 5,188,371 discloses a firearm target having a paper bottom layer colored with a photo-reflective ink, the bottom layer underlying a polypropylene film that is printed with a contrasting ink that contrasts with the photo-reflective ink on the bottom layer. For example, the bottom layer can be bright, even reflective, white, yellow, or orange and the polypropylene can be black. A projectile penetrating the target causes the contrasting ink to separate in an area that is larger than the hole left by the projectile. The reflective ink is thereby exposed and highly visible at the area of projectile's impact. It is for its teaching of targets and targets that show highly visible indications of a projectile's impact point that U.S. Pat. No. 5,188,371 is herein included by reference in its entirety.

U.S. Pat. No. 5,580,063 titled "Reusable Projectile Impact Reflecting Target for Day or Night Use" issued to Edwards on Dec. 3, 1996 and is herein incorporated by reference in its entirety. U.S. Pat. No. 5,580,063 discloses an improvement over Edwards' earlier target which is patented as U.S. Pat. No. 5,188,371. The improvements are in the replacement of certain parts of the target, the reuse of other parts of the target, and improvements directed to the visibility of projectile impact points. U.S. Pat. No. 5,580,063 also provides further disclosures relating to the target itself. It is for its further disclosures and improvements over those of U.S. Pat. No. 5,188,371 that U.S. Pat. No. 5,580,063 is herein included by reference in its entirety.

U.S. Pat. No. 5,501,467 titled "Highly Visible, Point of Impact, Firearm Target-Shatterable Face Sheet Embodiment" issued to Kandel on Mar. 26, 1996 and is herein incorporated by reference in its entirety. U.S. Pat. No. 5,501,467 discloses a target that produces highly visible indications of projectile impact points that is similar to Edwards' targets. It is for it teachings of targets and highly visible impact points that U.S. Pat. No. 5,501,467 is herein included by reference in its entirety.

U.S. Pat. No. 7,631,877 titled "Firearm Targets and Methods for Manufacturing Firearm Targets" issued to Zara on Dec. 15, 2009 and is herein incorporated by reference in its entirety. U.S. Pat. No. 7,631,877 also discloses a target that produces highly visible indications of projectile impact points but with refined layers, gaps in layers, and other improvements. It is for it teachings of refined layers, gaps in layers, and other improvements to targets having highly visible impact points that U.S. Pat. No. 7,631,877 is herein included by reference in its entirety.

The targets described so far provide highly visible indications of a projectiles point of impact. Yet earlier targets were typically light and dark patterns printed directly to a single substrate. None of the prior targets or technologies provide for improvements in aiming. System and methods providing for improvements in aiming at a firearm target are needed.

SUMMARY

The following summary is provided to facilitate an understanding of some of the innovative features unique to the disclosed embodiments and is not intended to be a full description. A full appreciation of the various aspects of the embodiments disclosed herein can be gained by taking the entire specification, claims, drawings, and abstract as a whole.

It is therefore an aspect of the embodiments to provide a firearm target having a substrate. The substrate can be printed with a background in a background color, perhaps with a reflective ink, and then a foreground pattern printed in a foreground color over or aligned to the background. The substrate can be printed with a background pattern in a background color, a foreground pattern in a foreground color, and flags, if present, in a flag color. An alternative is to print the foreground on a separable or frangible layer to thereby provide a target that produces highly visible indications of projectile impact points. Further alternatives can have multiple separable/frangible layers and multiple colors. For example, the background, foreground, and flags patterns can be printed on a separable layer with the substrate having a substrate color. The substrate color can be selected as a color that is different from the foreground, background, and flags. Yet further alternatives have a patterned substrate. For example, the background, foreground, and flags patterns can be printed on a separable layer and also in contrasting colors on the substrate.

It is another aspect of the embodiments that the foreground can have four trapezoid pairs arranged in a cross pattern having a center point. Each trapezoid pair includes two right trapezoids with each right trapezoid having a long edge perpendicular to a base edge and parallel to a short edge. An angled edge opposite the base edge joins the long edge and the short edge. The intersection of the long edge and angled edge is a pinnacle. The right trapezoids in a trapezoid pair are arranged with their long edges being parallel and separated by a trapezoid separation. Certain embodiments have a trapezoid separation of 5/16 inch or within 1/16 inch of 5/16 inch. The distance can be selected to match the reticle of a rifle scope with some scopes being variable. Therefore, other embodiments can have other trapezoid separation such as ⅝ inch or within 1/16 inch of ⅝ inch. In general, a target has a reticle distance equaling the trapezoid separation when the trapezoid separation is greater than zero. Embodiments can have a trapezoid separation equaling zero in which case the trapezoid pair becomes an obelisk, which is a pointed five sided shape, and the reticle distance equaling the width of the obelisk. The trapezoid pairs and/or obelisks are arranged in a cross pattern with the trapezoid pinnacles (or obelisk points) pointing inward toward the center of the target.

Experimentation has shown that for an optic having a lower power zoom such as 1×-5× and straight 4× power work particularly well with a ⅞ inch reticle distance. The tested targets having a ⅞ inch reticle distance included a twelve inch square target having a ⅞ inch trapezoid separation and a twelve inch square target having a ⅞ inch cross thickness. A twelve inch square target is a square target with each side being twelve inches long.

Obelisk, as used herein, refers to a shape with two parallel sides that terminate in a symmetrical pointed tip portion. It has been observed that a true obelisk does not have parallel sides. Without comment on if a true obelisk can have parallel sides, obelisks herein refer to a shape having parallel sides.

It is yet another aspect of the embodiments that the foreground has four kite shaped wedges, each having a first angled side intersecting a second angled side at a vertex. Certain embodiments have vertices of 34 degrees or vertices within one or two degrees of 34 degrees. An axis bisects the vertex and the wedges are symmetrical along the axis. The wedges can be arranged in a wedge pattern with each vertex at or proximate to the center point of the cross pattern. The axes of two of the wedges can be perpendicular to the axes of the other two wedges. In many embodiments the axes of the wedges are rotated 45 degrees from the cross pattern.

It is a further aspect of the embodiments that the target can have a plurality of flags that are colored in a flag color that is different from the foreground color and the background color. The flags are somewhat triangular in shape with the three sides being a long side, short side, and curved side. The long side and the curved side are connected at the flag tip. The long side and the short side are connected at the flag vertex. The ends of the long side are the flag tip and the flag vertex. Experiment has shown that a concave curved side works well. Here, concave means that the curved side is curved such that its midpoint is closer to the long side than the midpoint of a straight line would be. The long side of each flag lies on either the first or second angled side of a wedge. The flag tip is the part of the flag closest to the center point.

To simplify description herein, some of the target's patterning is described as foreground whereas other patterning is described as background. It is understood that the calling some parts "foreground" and other parts "background" background is a handy but arbitrary labeling target elements. The nomenclature can be changed without changing the appearance of the target.

The foreground and background colors can be specified using color coordinates, as Pantone color numbers, or as colors on a Pantone card. For example, a target having a red foreground and a yellow background can be specified as having a "Pantone card 1.3c Yellow" or pantone 1.3c "process yellow" background and a "Pantone 1795c" foreground. Experimentation has shown that the coated basic process yellow is a good color for many targets. A different target having a yellow foreground and a blue background can be specified as having a "Pantone 311c" background and a "Pantone card 1.3c Process Yellow" foreground.

The "c" after the number (as in 311c or 1795c) or the card number (as in 1.3c) means coated for its brightness so it stands out. It's the contrast and brightness of colors that can make cross hairs in optics stand out for maximum visibility. This way a black cross hair never blends into a black background such as in that of FIGS. 14-16.

Some embodiments can have a plurality of offset marks. For example, if the wedges are the foreground color, then each wedge can have a square (or diamond or kite or circular or round or elliptical or triangular or polygonal) shaped offset mark in the background color or some other contrasting color.

BRIEF DESCRIPTION OF THE FIGURES

The accompanying figures, in which like reference numerals refer to identical or functionally-similar elements throughout the separate views and which are incorporated in and form a part of the specification, further illustrate the present embodiments and, together with the detailed description of the embodiments, serve to explain the principles of the present embodiments. The figures are not necessarily to scale or full scale.

DETAILED DESCRIPTION

The particular values and configurations discussed in these non-limiting examples can be varied and are cited merely to illustrate at least one embodiment and are not intended to limit the scope thereof.

The embodiments will now be described more fully hereinafter with reference to the accompanying drawings, in which illustrative embodiments of the embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout. As used herein, the term "and/or" includes any and all combinations of one or more of the associated listed items.

Figure 1:
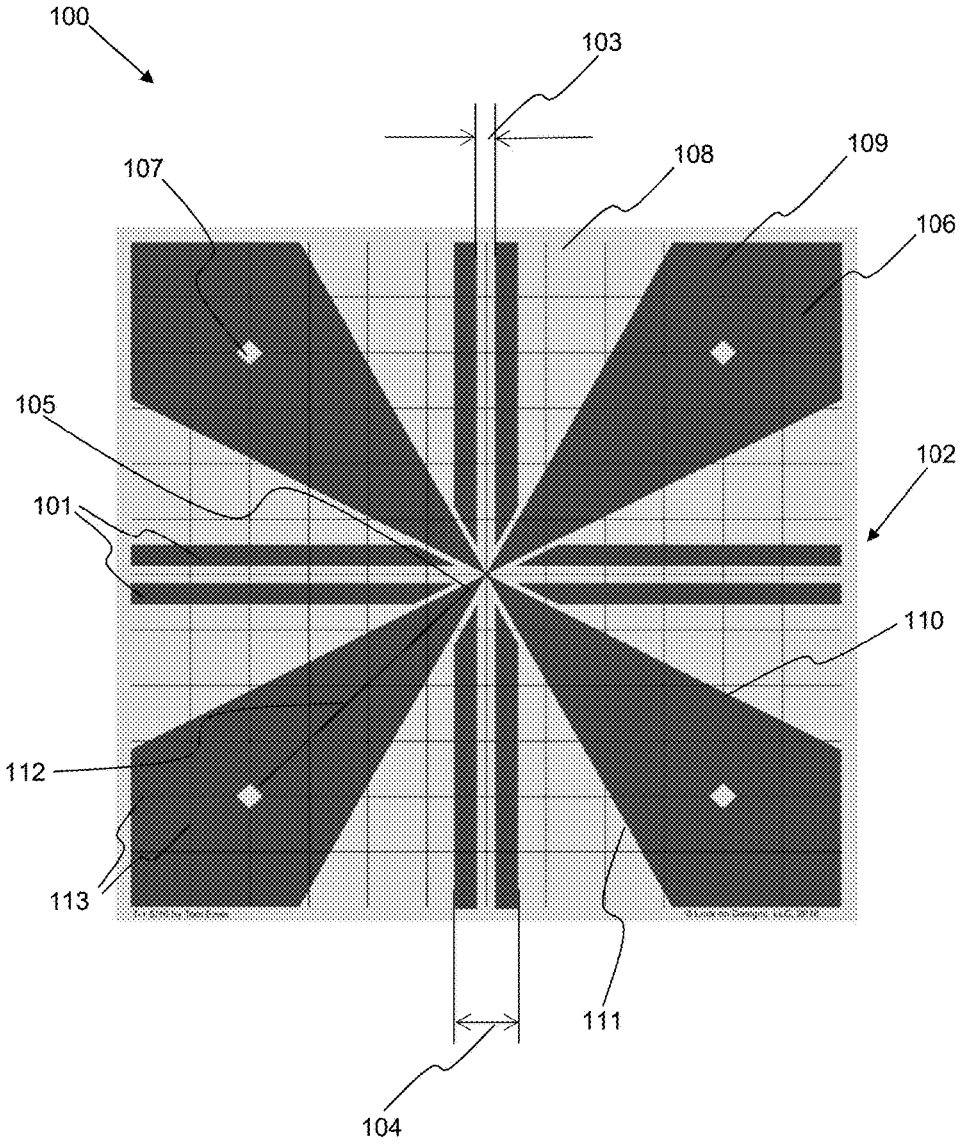
FIG. 1 illustrates a target having a 5/16 inch trapezoid separation and a reticle distance equaling the trapezoid separation in accordance with aspects of the embodiments.

FIG. 1 illustrates a target 100 having a 5/16 inch trapezoid separation 103 and a reticle distance equaling the trapezoid separation 103 in accordance with aspects of the embodiments. Four trapezoid pairs 102 having two right trapezoids 101 are arranged in a cross pattern marked as element 201 in FIG. 2. The target 100 also has four wedges 106 having a first angled side 110, a second angled side 111, and a vertex 105 that is the angled tip between the first angled side 110 and the second angled side 111. An axis 112 bisects the vertex. The axis 112 is illustrated as a line bisecting a vertex 105, but such a line is not visible in all embodiments. Each leg of the cross pattern 201 has a cross thickness 104 equaling the trapezoid separation 103 plus two of the base lengths of the right trapezoid. The base lengths are the lengths of elements 302 in FIG. 3 below. Each of the wedges 106 has an offset mark 107 centered on the axis 112.

Target 100 has a foreground 109 that can be blaze orange, fluorescent orange, or red such as the red specified as "Pantone 1795c." Target 100 also has a background 108 that can be in a color that contrasts well with the foreground color. For example, "Pantone card 1.3c Yellow" contrasts well with "Pantone 1795c." Another example would have a black foreground and white background while yet another example would have a white foreground and a black background.

Target 100 has grid lines 113 arranged in a grid. The illustrated grid lines 113 are black. The black gridlines 113 are visible against both the foreground color and the background color. If the gridlines 113 illustrated in FIG. 1 are spaced by one inch, then target 100 is approximately 12 inches by 12 inches and the illustrated offset marks 107 would be approximately two inches in from each edge. The measurements become important because a reticle distance of 5/16 inch is well suited for sighting in a scoped rifle at 100 yards because the reticle of many scopes is sized to almost completely obscure the space between the right trapezoids of each trapezoid pair. A marksman aiming at the target is therefore able to "lock on" the target by almost or completely blanking out that space, based on marksman preferences. Slight offsets from the ideal lock on position are highly visible because strips of bright contrasting color appear in the marksman's sight image. This enables a shooter the ability to lock on and keep crosshairs on the center point of the target without wavering. Increased accuracy and ability can improve with repetitive use of the targets, thereby increasing skill levels.

The target having the 5/16 inch trapezoid separation and a reticle distance equaling the trapezoid separation can also work well for 50 yard distances for low power scopes such as a four power scope or variable power scope set to lower power. Similarly, a larger reticle distance, such as 1/2 inch or even larger, for example 3/4 inch has worked excellently in testing, can be used by lower power scopes at longer ranges such as 100 yards or 200 yards. The key is matching the target's reticle distance to the thickness of the scope's crosshairs at the distance being shot at. Furthermore, a variable scope can be adjusted to achieve optimal blanking of the lock on pattern.

Most reticles are black with the exception of certain reticles such as illuminated reticles. For constant reticle visibility, the foreground and background colors are ideally selected to contrast with the reticle color as well as with each other. It is for this reason that yellow, red, and blue have been selected as example foreground and background colors because they contrast with a black reticle.

The shapes of the wedges 106 are designed to guide the marksman's eye to the center of the target and into the ideal locked on position where the scope reticle completely or almost completely blanks the background color strips running down the center of each leg of the cross pattern. Recall that each leg of the cross pattern is a trapezoid pair.

Experimentation has shown that wedges having a 34 degree angle at the vertex produce excellent results.

The offset marks 107 can be used by a marksman to test the mechanics of a firearm scope. Firearm scopes and their reticles are notoriously well known to those who enjoy, build, market, or repair firearms. A firearm scope is an optical sighting/aiming aid typically using lenses to magnify the image of a target and to display a reticle over top of the target. Returning now to the embodiments, a sighted in firearm should reliably place shots in the middle of the target at the center 202. Assuming that target 100 is 12"×12", the offset marks are four inches in each direction from the target center 202. If a scope has "½ inch clicks," then a marksman can enter eight clicks right, eight clicks up, aim at the target center, pull the trigger, and hit the top right offset mark. By then, entering sixteen clicks left and shooting for the target center, the marksman hits the top left offset mark. It is by entering clicks into the scope and observing projectile impacts that a marksman can determine how well the mechanisms within the scope are operating.

The foreground and background colors can be specified using color coordinates, as Pantone color numbers, or as colors on a Pantone card. For example, a target having a red foreground and a yellow background can be specified as having a "Pantone card 1.3c Yellow" background and a "Pantone 1795c" foreground. A different target having a yellow foreground and a blue background can be specified as having a "Pantone 311c" background and a "Pantone card 1.3c Yellow" foreground. Yet other embodiments can have a "Pantone card 1.3c Yellow" foreground and a highly contrasting background such as "Pantone 311c" blue. Note that "Pantone card 1.3c Yellow" is also known as "Pantone card 1.3c Process Yellow".

Figure 2:
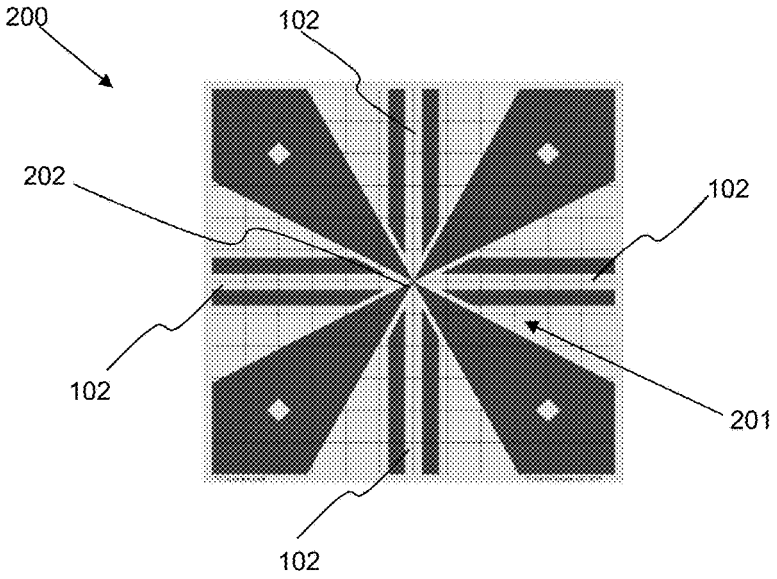
FIG. 2 illustrates a target having a ½ inch trapezoid separation and a reticle distance equaling the trapezoid separation in accordance with aspects of the embodiments.

FIG. 2 illustrates a target 200 having a ½ inch trapezoid separation 103 and a reticle distance equaling the trapezoid separation 103 in accordance with aspects of the embodiments. Four trapezoid pairs 102 form a cross pattern 201 having a center 202.

Figure 3:
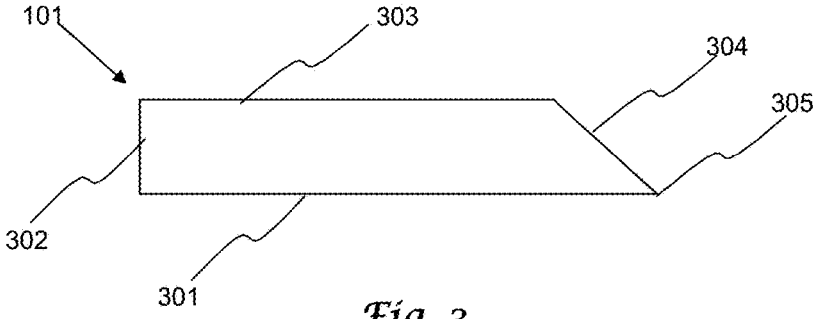
FIG. 3 illustrates a right trapezoid in accordance with aspects of the embodiments.

FIG. 3 illustrates a right trapezoid 101 in accordance with aspects of the embodiments. The right trapezoid 101 has a long edge 301, base edge 302, short edge 303, and angled edge 304. The base edge 302 has a length here called the base length. The long edge 301 and the angled edge 304 meet at a pinnacle 305. In the embodiments illustrated herein, the pinnacle is the point on the right trapezoid that is closest to the center 202.

Figure 4:
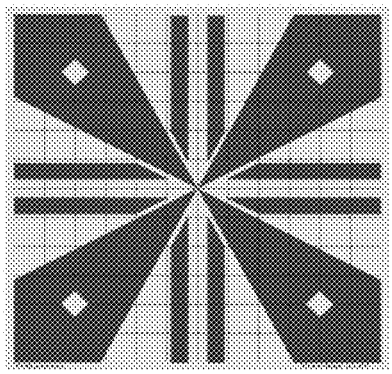
FIG. 4 illustrates a target having a ⅝ inch trapezoid separation and a reticle distance equaling the trapezoid separation in accordance with aspects of the embodiments.

FIG. 4 illustrates a target 400 having a ⅝ inch trapezoid separation 103 and a reticle distance equaling the trapezoid separation 103 in accordance with aspects of the embodiments. A ⅝ inch trapezoid separation (plus or minus printing tolerances and minor deviations) provides a workable reticle distance for many scopes at a 100 yard distance, particularly lower powered optics such as, for example, fixed four power scopes or 1×-5× variable scopes. In addition, different scopes can have different thickness reticles depending on manufacturer or manufacturer's model.

Figure 5:
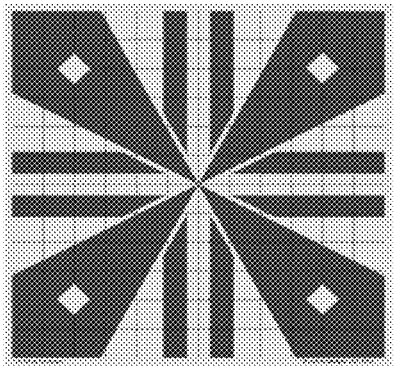
FIG. 5 illustrates a target having a ¾ inch trapezoid separation and a reticle distance equaling the trapezoid separation in accordance with aspects of the embodiments.

FIG. 5 illustrates a target 500 having a ¾ inch trapezoid separation 103 and a reticle distance equaling the trapezoid separation 103 in accordance with aspects of the embodiments.

Figure 6:
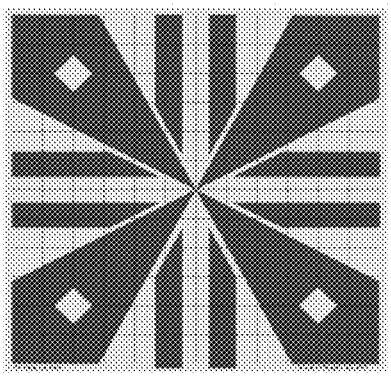
FIG. 6 illustrates a target having a ⅞ inch trapezoid separation and a reticle distance equaling the trapezoid separation in accordance with aspects of the embodiments.

FIG. 6 illustrates a target 600 having a ⅞ inch trapezoid separation 103 and a reticle distance equaling the trapezoid separation 103 in accordance with aspects of the embodiments. Recall that the ⅞ inch trapezoid separation (plus or minus printing tolerances and minor deviations) provided an optimal reticle distance for many scopes at a 100 yard distance, particularly lower powered optics such as, for example, fixed four power scopes or 1×-5× variable scopes. In addition, different scopes can have different thickness reticles depending on manufacturer or manufacturer's model.

Figure 7:
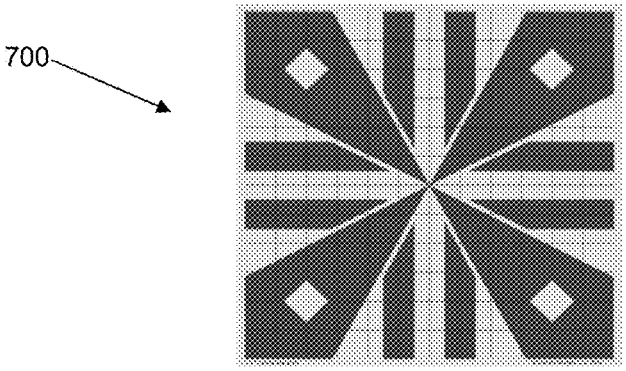
FIG. 7 illustrates a target having a 1 inch trapezoid separation and a reticle distance equaling the trapezoid separation in accordance with aspects of the embodiments.

FIG. 7 illustrates a target 700 having a 1 inch trapezoid separation 103 and a reticle distance equaling the trapezoid separation 103 in accordance with aspects of the embodiments. Notice that in this non-limiting example, the offset marks 107 appear approximately one inch square and that certain grid lines 113 appear to bisect the right trapezoids 101 along their long axis. The size of the offset marks 107 does not need to match the reticle distance 103. For example, 1 inch square offset marks 107 may be on a ⅝ inch reticle distance target. As a further generalization, the offset marks 107 do not have to be centered on the target diagonals, on the axes of the wedges 112, or two inches from the target sides. It is preferable, however, that the number of scope "clicks" from the center 202 to the offset mark 107 is easy to calculate. As such, it may be better for offset marks 107 to be offset from the target center 202 by an integer number of inches.

Figure 8:
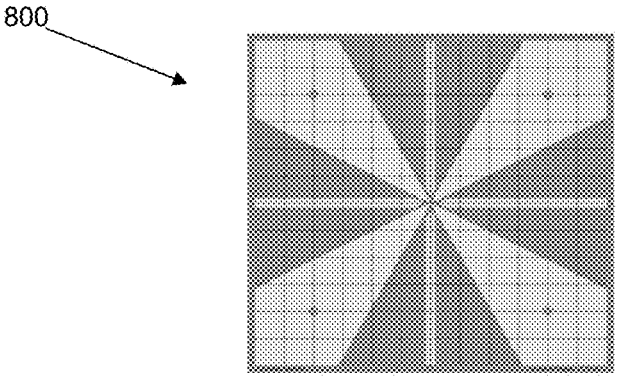
FIG. 8 illustrates a target having a 0 inch trapezoid separation and a 5/16 inch cross thickness such that each trapezoid pair becomes an obelisk and the reticle distance equals the cross thickness in accordance with aspects of the embodiments.

FIG. 8 illustrates a target 800 having a 0 inch trapezoid separation and a 5/16 inch cross thickness such that each trapezoid pair becomes an obelisk and the reticle distance equals the cross thickness in accordance with aspects of the embodiments. Here, the "lock on" principal is somewhat altered in that the reticle blanks, or nearly blanks, the entire cross pattern. The word "blank" is understood to mean obscures, hides, or completely overlays. Some marksmen prefer for the reticle to completely blank the cross pattern of this embodiment or the centers of the cross patterns of the embodiments of FIGS. 1-2 and 4-7. Other marksmen prefer nearly blanked over fully blanked.

Figure 9:
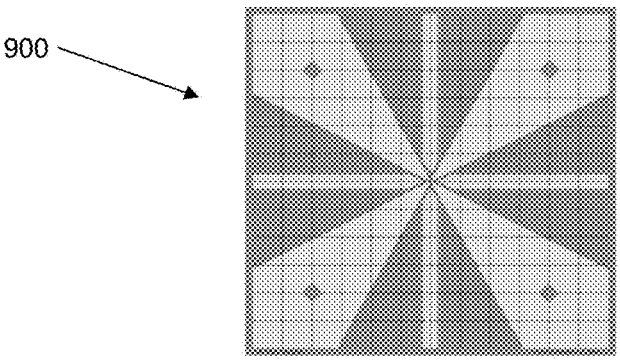
FIG. 9 illustrates a target having a 0 inch trapezoid separation and a ½ inch cross thickness such that each trapezoid pair becomes an obelisk and the reticle distance equals the cross thickness in accordance with aspects of the embodiments.

FIG. 9 illustrates a target 900 having a 0 inch trapezoid separation and a ½ inch cross thickness such that each trapezoid pair becomes an obelisk and the reticle distance equals the cross thickness in accordance with aspects of the embodiments.

Figure 10:
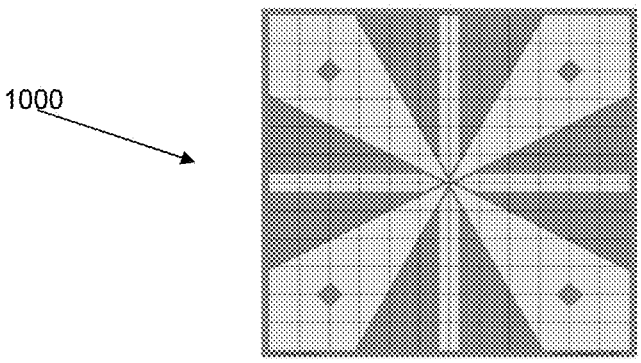
FIG. 10 illustrates a target having a 0 inch trapezoid separation and a ⅝ inch cross thickness such that each trapezoid pair becomes an obelisk and the reticle distance equals the cross thickness in accordance with aspects of the embodiments.

FIG. 10 illustrates a target 1000 having a 0 inch trapezoid separation and a ⅝ inch cross thickness such that each trapezoid pair becomes an obelisk and the reticle distance equals the cross thickness in accordance with aspects of the embodiments.

Figure 11:
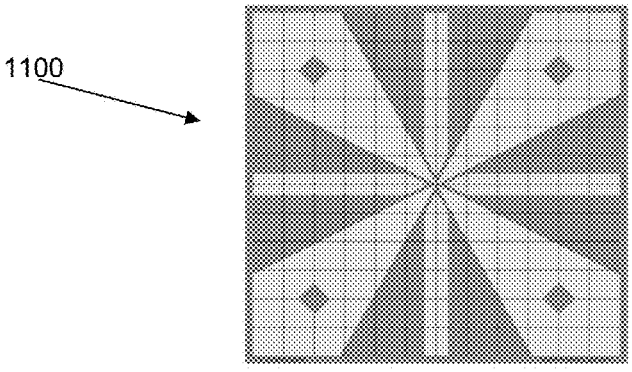
FIG. 11 illustrates a target having a 0 inch trapezoid separation and a ¾ inch cross thickness such that each trapezoid pair becomes an obelisk and the reticle distance equals the cross thickness in accordance with aspects of the embodiments.

FIG. 11 illustrates a target 1100 having a 0 inch trapezoid separation and a ¾ inch cross thickness such that each trapezoid pair becomes an obelisk and the reticle distance equals the cross thickness in accordance with aspects of the embodiments.

Figure 12:
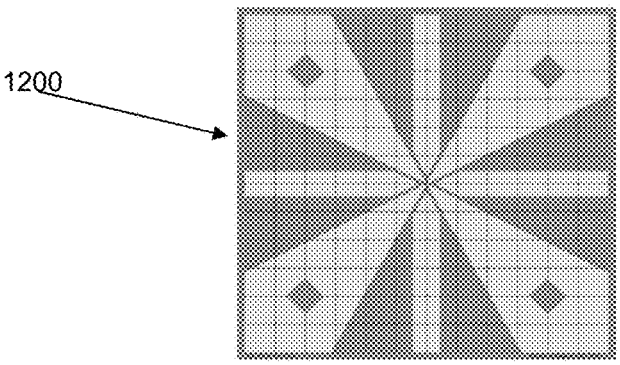
FIG. 12 illustrates a target having a 0 inch trapezoid separation and a ⅞ inch cross thickness such that each trapezoid pair becomes an obelisk and the reticle distance equals the cross thickness in accordance with aspects of the embodiments.

FIG. 12 illustrates a target 1200 having a 0 inch trapezoid separation and a ⅞ inch cross thickness such that each trapezoid pair becomes an obelisk and the reticle distance equals the cross thickness in accordance with aspects of the embodiments.

Figure 13:
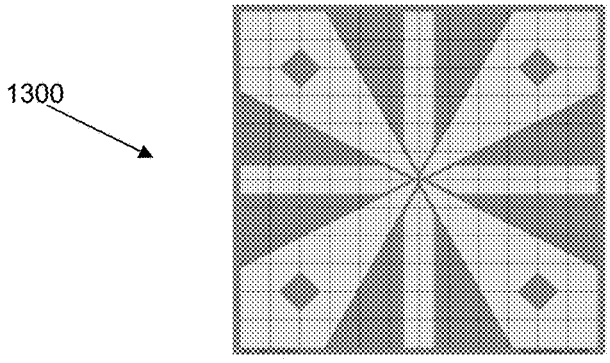
FIG. 13 illustrates a target having a 0 inch trapezoid separation and a 1 inch cross thickness such that each trapezoid pair becomes an obelisk and the reticle distance equals the cross thickness in accordance with aspects of the embodiments.

FIG. 13 illustrates a target 1300 having a 0 inch trapezoid separation and a 1 inch cross thickness such that each trapezoid pair becomes an obelisk and the reticle distance equals the cross thickness in accordance with aspects of the embodiments.

Figure 14:
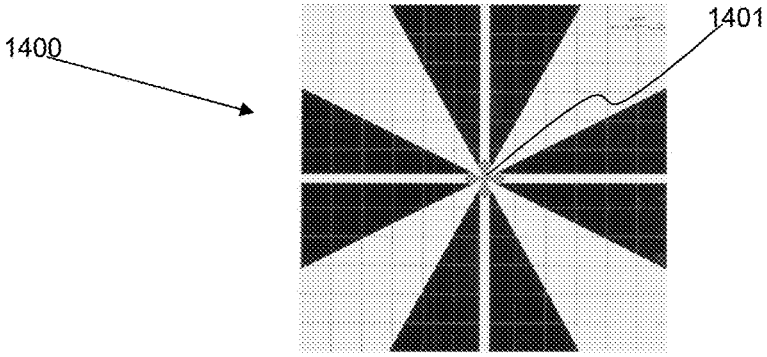
FIG. 14 illustrates a target having a 0 inch trapezoid separation, a 5/16 inch cross thickness, and a center structure such that each trapezoid pair becomes an obelisk and the reticle distance equals the cross thickness in accordance with aspects of the embodiments.

FIG. 14 illustrates a target 1400 having a 0 inch trapezoid separation, a 5/16 inch cross thickness, and a center structure 1401 such that each trapezoid pair becomes an obelisk and the reticle distance equals the cross thickness in accordance with aspects of the embodiments. The embodiment illustrated in FIG. 14 does not show the points of the obelisks because the center structure is at the center of the target. This can be achieved by, for example, overlaying the center structure over the obelisk points and therefore hiding the obelisk points. Target 1400 is similar to targets 800, 900, 1000, 1100, 1200, and 1300 excepting that target 1400 does not have offset marks, but does have a center structure 1401. The center structure is four kite shapes, each approximately as thick as or slightly thicker than the cross thickness and meeting at the center 202. The foreground can be in a yellow color such as "Pantone card 1.3c Yellow" while the background is black. The center structure can be in a third color such as blaze orange. The grid lines can be in a fourth color such as a green color that is visible against both a yellow foreground and a black background. Note that the centermost gridlines of other illustrated embodiments are not present in the embodiment of FIG. 14 and, as such, the center structure is not overlaid with a grid line.

Figure 15:
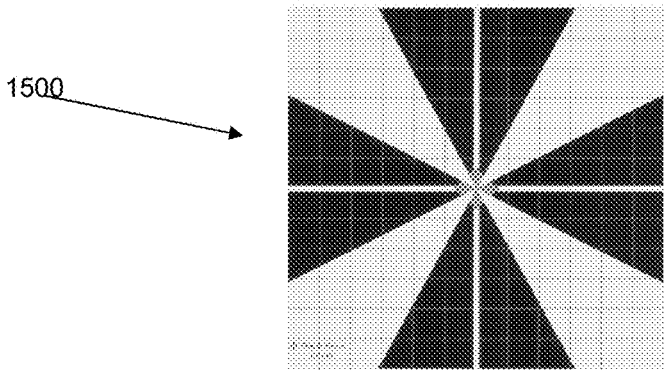
FIG. 15 illustrates a target having a 0 inch trapezoid separation, a 3/16 inch cross thickness, and a center structure such that each trapezoid pair becomes an obelisk and the reticle distance equals the cross thickness in accordance with aspects of the embodiments.

FIG. 15 illustrates a target 1500 having a 0 inch trapezoid separation, a 3/16 inch cross thickness, and a center structure 1401 such that each trapezoid pair becomes an obelisk and the reticle distance equals the cross thickness in accordance with aspects of the embodiments.

Figure 16:
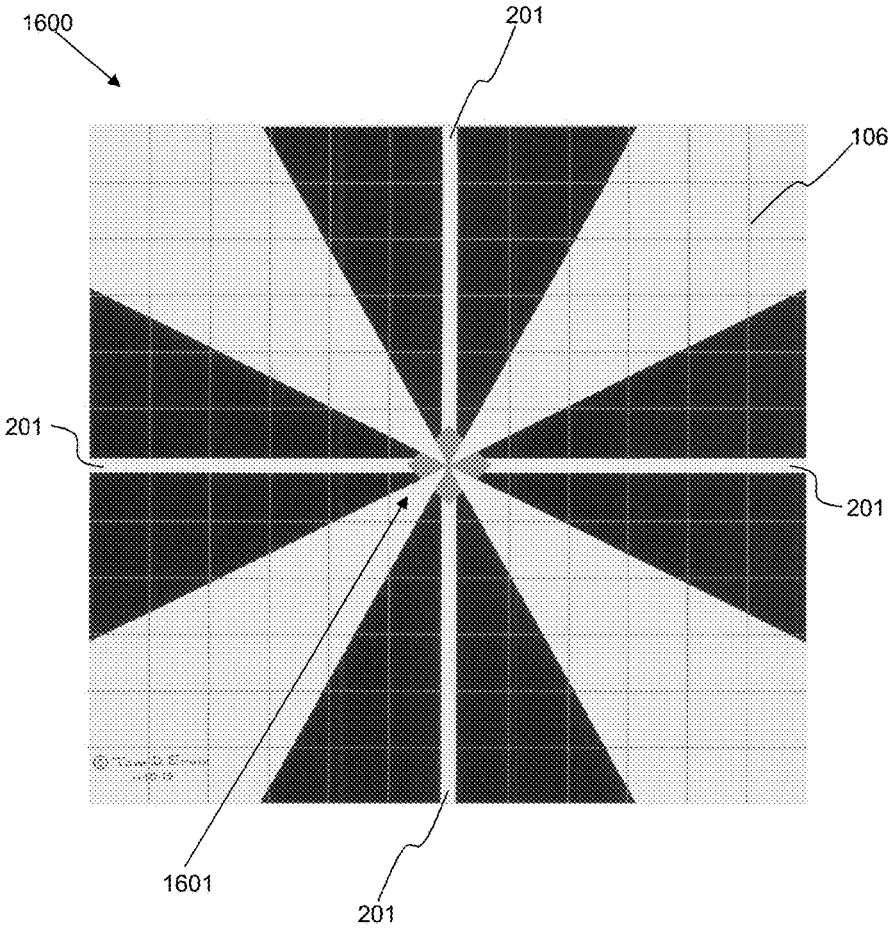
FIG. 16 illustrates a target having a 0 inch trapezoid separation, a 1/4 inch cross thickness, and a center structure such that each trapezoid pair becomes an obelisk and the reticle distance equals the cross thickness in accordance with aspects of the embodiments.

FIG. 16 illustrates a target 1600 having a 0 inch trapezoid separation, a ¼ inch cross thickness, and a center structure 1601 such that each trapezoid pair becomes an obelisk and the reticle distance equals the cross thickness in accordance with aspects of the embodiments.

Figure 17:
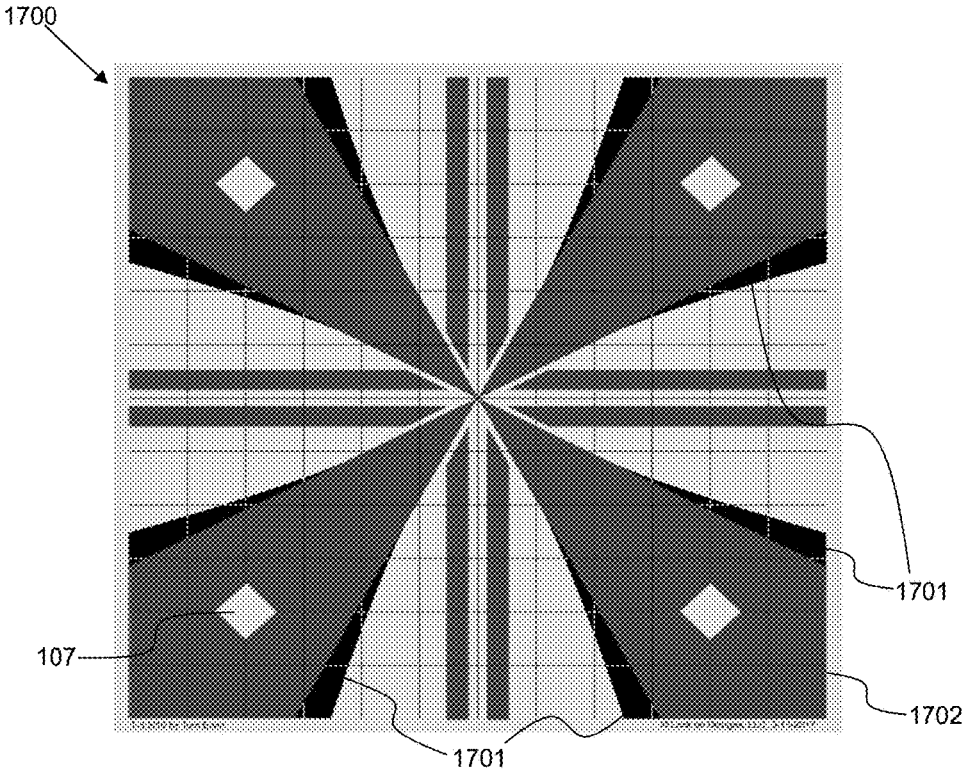
FIG. 17 illustrates a target having a 5/16 inch trapezoid separation, eight flags, and a reticle distance equaling the trapezoid separation in accordance with aspects of the embodiments.

FIG. 17 illustrates a target 1700 having a 5/16 inch trapezoid separation, eight flags 1701, and a reticle distance equaling the trapezoid separation in accordance with aspects of the embodiments. As illustrated in FIG. 17, the background color is yellow such as Pantone 1.3c Yellow, the foreground color is red such as Pantone 1795c, and the flag color is black such as one of the Pantone process black colors. The flag color is not the same as the foreground or background color because otherwise the flag would simply disappear into the foreground or background. Note that a flag having the foreground color could result in wedges appearing to have curved sides.

Figure 18:
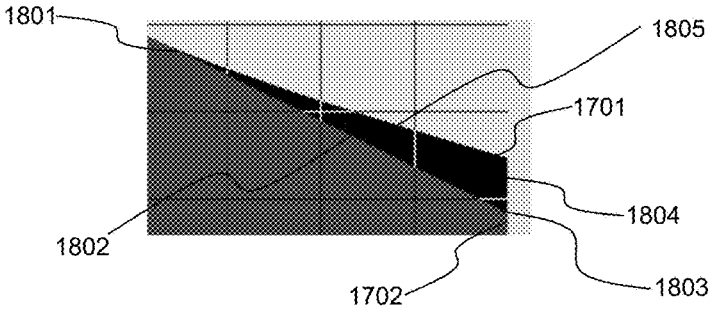
FIG. 18 illustrates a flag in accordance with aspects of the embodiments.

FIG. 18. illustrates a flag 1701 in accordance with aspects of the embodiments. Flag 1701 is substantially triangular in shape with the three sides being a long side 1802, short side 1804, and curved side 1805. The long side 1802 and the curved side 1805 are connected at the flag tip 1801. FIG. 18 presents a zoomed section of the lower right quadrant of the target of FIG. 17. The long side 1802 and the short side 1804 are connected at the flag vertex 1803. The ends of the long side 1802 are the flag tip 1801 and the flag vertex 1803. Experiment has shown that a concave curved side 1805 works well. Here, concave means that the curved side is curved such that its midpoint is closer to the long side 1802 than the midpoint of a straight line would be. The curved side 1805 can be a circular arc such as that illustrated in FIG. 18 where the radius appears to be much larger than the target height or width. For example, a twelve inch square target, as discussed above, has a twelve inch height and a twelve inch width. When the target of FIG. 17 is scaled to be a twelve inch square target then the flag radius of FIGS. 17 and 18 appears to be approximately three feet. The long side 1802 of each flag lies on either the first angled side 110 or second angled side of a wedge 111. The flag tip 1801 is the part of the flag 1701 closest to the target center 202 where the wedges 106 meet. As illustrated, the flag vertex 1803 can also be an end point for the first or second angled side 110, 111. Furthermore, the short side 1804 can be collinear with an edge 1702 of a wedge 106.

Target 1700 has offset marks 107 that are diamond shaped having sides of about ¾ inch, which is not the same as the trapezoid separation but are, in the illustrated embodiment, much larger. Target 1700 is here imagined to have 12 inch long side with a one inch grid. Note that the grid lines illustrated in FIGS. 17-21 change color where the grid intersects the flags 1701. The grid, being black, would otherwise be invisible over the black flag. As such, the illustrated embodiments of FIGS. 17-19 have colored that portion of the grid in the background color. The illustrated embodiments of FIGS. 20-21 have colored that portion of the grid in the foreground color. A different color can be used or the grid can be left as is regardless of the flag color.

Figure 19:
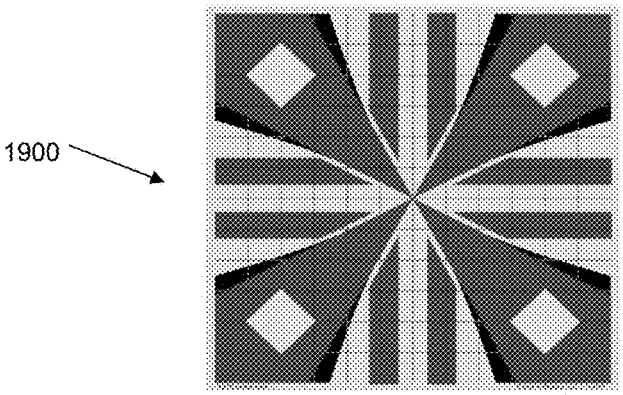
FIG. 19 illustrates a target having a 7/8 inch trapezoid separation, eight flags, and a reticle distance equaling the trapezoid separation in accordance with aspects of the embodiments.

FIG. 19 illustrates a target 1900 having a ⅞ inch trapezoid separation, eight flags, and a reticle distance equaling the trapezoid separation in accordance with aspects of the embodiments. As illustrated in FIG. 19, the offset marks 107 have sides measuring 1.5 inches.

Figure 20:
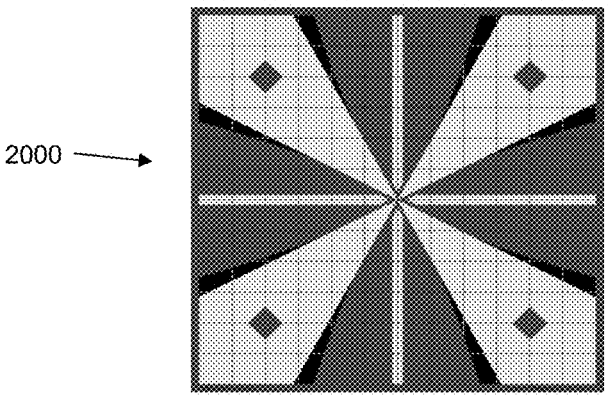
FIG. 20 illustrates a target having a 0 inch trapezoid separation, a 5/16 inch cross thickness, eight flags, and a center structure such that each trapezoid pair becomes an obelisk and the reticle distance equals the cross thickness in accordance with aspects of the embodiments.

FIG. 20 illustrates a target 2000 having a 0 inch trapezoid separation, a 5/16 inch cross thickness, eight flags, and a center structure such that each trapezoid pair becomes an obelisk and the reticle distance equals the cross thickness in accordance with aspects of the embodiments.

Figure 21:
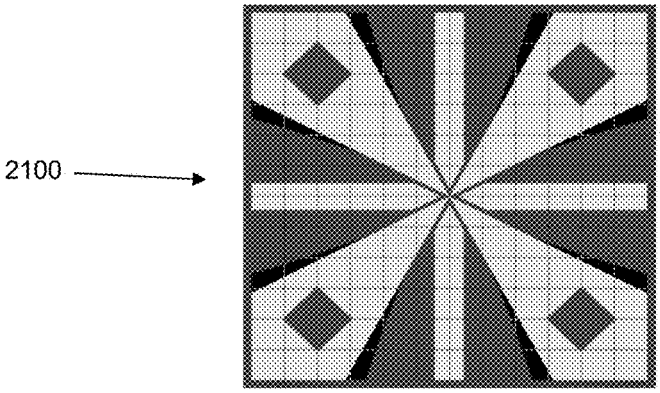
FIG. 21 illustrates a target having a 0 inch trapezoid separation, a 7/8 inch cross thickness, eight flags, and a center structure such that each trapezoid pair becomes an obelisk and the reticle distance equals the cross thickness in accordance with aspects of the embodiments.

FIG. 21 illustrates a target 2100 having a 0 inch trapezoid separation, a ⅞ inch cross thickness, eight flags, and a center structure such that each trapezoid pair becomes an obelisk and the reticle distance equals the cross thickness in accordance with aspects of the embodiments.

The offset marks 107 of FIGS. 20-21 are similar in size to those of FIGS. 17, 19 when it is imagined that the targets are 12 inches square with one inch grids.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A firearm target comprising:

a substrate;

a background comprising a background color;

four wedges wherein each wedge comprises a first angled side, a second angled side, a vertex between the first angled side and the second angled side, and an axis bisecting the vertex, and wherein the wedges are symmetrical along the axis;

a wedge pattern comprising the four wedges and a center point wherein each vertex is at the center point and wherein the two axes of two of the wedges are perpendicular to the two axes of the other two wedges;

a foreground comprising a foreground color, and the wedge pattern;

a plurality of flags wherein each flag comprises a flag color, a flag tip, a flag vertex, a long side between the flag tip and the flag vertex, a short side adjoining the long side at the flag vertex, and a curved side adjoining the long side and the short side, wherein the long side and the curved side adjoin at the flag tip, wherein each wedge has a first flag abutting the first angled side with the flag vertex of the first flag on one end of the first angled side and with the flag tip of the first flag on the first angled side between the first flag vertex and the vertex, wherein each wedge has a second flag abutting the second angled side with the flag vertex of the second flag on one end of the second angled side, and with the flag tip of the second flag on the second angled side between the second flag vertex and the vertex; and wherein the background color, foreground color, and flag color are different colors.

2. The firearm target of claim 1 further comprising:

four trapezoid pairs comprising two right trapezoids wherein each right trapezoid has a long edge, a pinnacle, and an angled edge, wherein the right trapezoids are arranged with parallel long edges separated by a trapezoid separation;

a cross pattern comprising the trapezoid pairs and the center point; and wherein the foreground further comprises the cross pattern.

3. The firearm target of claim 2 wherein the curved side is concave.

4. The firearm target of claim 2 wherein each flag's long side is at least 50% as long as the first angled side and wherein each flag's long side is at least 50% as long as the second angled side.

5. The firearm target of claim 2 wherein each flag's long side is no more than 75% as long as the first angled side and wherein each flag's long side is no more than 75% as long as the second angled side.

6. The firearm target of claim 2 wherein the background color is a yellow color specified as Pantone card 1.3c Yellow, wherein the foreground color is a red color specified as Pantone 1795c, and wherein the flag color is a black color specified as a Pantone process black color.

7. The firearm target of claim 2 wherein the foreground color is a yellow color specified as Pantone card 1.3c Process Yellow, and wherein the flag color is a black color specified as a Pantone process black color.

8. The target of claim 2 wherein the trapezoid separation is zero such that each trapezoid pair forms an obelisk and wherein each obelisk has a cross thickness.

9. The firearm target of claim 1 wherein the background color is produced with a reflective ink.

10. The firearm target of claim 1 further comprising a separable layer disposed over the substrate wherein the substrate is colored with the background color, wherein the background color is produced with a reflective ink, wherein the foreground and the flags are patterned on the separable layer, and wherein a projectile impacting the target at an impact point causes the separable layer to separate from the substrate in a halo around the impact point.

11. The firearm target of claim 1 further comprising at least one separable layer overlaying the substrate wherein the background, the foreground, and the flags are patterned on the at least one separable layer, wherein the substrate is colored with a substrate color, and wherein a projectile impacting the target at an impact point causes the separable layer to separate from the substrate in a halo around the impact point.

12. The firearm target of claim 1 further comprising a plurality of offset marks in the wedges wherein the offset marks are in the background color.

13. The firearm target of claim 1 wherein the foreground color is produced with a reflective ink and the background color is produced with a different reflective ink.

14. The target of claim 13 wherein the reflective ink is not black and wherein the different reflective ink is not black.

15. The target of claim 1 wherein each wedge vertex has an angle greater than 32 degrees and less than 36 degrees.

16. A firearm target comprising:

a substrate;

a background comprising a background color;

four obelisks arranged in a cross pattern with a center point wherein each obelisk has a cross thickness;

four wedges wherein each wedge comprises a first angled side, a second angled side, a vertex between the first angled side and the second angled side, and an axis bisecting the vertex, and wherein the wedges are symmetrical along the axis;

a wedge pattern wherein each vertex is at the center point and wherein the two axes of two of the wedges are perpendicular to the two axes of the other two wedges; and a foreground comprising a foreground color, the cross pattern, and the wedge pattern;

a plurality of flags wherein each flag comprises a flag color, a flag tip, a flag vertex, a long side between the flag tip and the flag vertex, a short side adjoining the long side at the flag vertex, and a curved side adjoining the long side and the short side, wherein the long side and the curved side adjoin at the flag tip, wherein each wedge has a first flag abutting the first angled side with the flag vertex of the first flag on one end of the first angled side and with the flag tip of the first flag on the first angled side between the first flag vertex and the vertex, wherein each wedge has a second flag abutting the second angled side with the flag vertex of the second flag on one end of the second angled side, and with the flag tip of the second flag on the second angled side between the second flag vertex and the vertex; and wherein the background color, foreground color, and flag color are different colors.

17. The target of claim 16 wherein each wedge vertex has an angle greater than 32 degrees and less than 36 degrees.

18. The firearm target of claim 16 wherein the curved side is concave.

19. The firearm target of claim 16 wherein each flag's long side is at least 50% as long as the first angled side and wherein each flag's long side is at least 50% as long as the second angled side.

20. The firearm target of claim 16 wherein each flag's long side is no more than 75% as long as the first angled side and wherein each flag's long side is no more than 75% as long as the second angled side.

* * * * *